US005688041A

United States Patent [19]

Arndt

[11] Patent Number: 5,688,041

[45] Date of Patent: Nov. 18, 1997

[54] DEMARCATION LIGHTING SYSTEM

[75] Inventor: Dieter Arndt, Wohnsitz, Germany

[73] Assignee: Georg Robel GmbH & Co., München, Germany

[21] Appl. No.: 446,497

[22] Filed: May 22, 1995

[30] Foreign Application Priority Data

May 26, 1994 [DE] Germany ..... 44 18 301.1

[51] Int. Cl.[6] ..... H01R 33/00

[52] U.S. Cl. ..... 362/226; 362/152; 362/240; 362/249; 362/431; 362/267; 362/219

[58] Field of Search ..... 362/152, 234, 362/240, 238, 248, 249, 226, 370, 410, 431, 267, 252, 219

[56] References Cited

U.S. PATENT DOCUMENTS 4,607,317 8/1986 Lin ..... 362/249

5,309,658 5/1994 Cohen et al. ..... 362/252 X

*Primary Examiner*—Stephen F. Husar

*Attorney, Agent, or Firm*—Henry M. Feiereisen

[57] ABSTRACT

A demarcation lighting system for separating danger zones and work areas, includes a transparent lamp assembly accommodating a lamp and being made of tubular, flexible material. Each axial end of the lamp assembly is equipped with a coupling for allowing a detachable connection of a further lamp assembly.

39 Claims, 1 Drawing Sheet

DEMARCATION LIGHTING SYSTEM

BACKGROUND OF THE INVENTION

The present invention refers to a demarcation lighting system for separating danger zones and work areas, and in particular is concerned with a demarcation lighting system of a type having a transparent lamp assembly including a lamp.

Danger zones and work areas, primarily construction sites, are bounded through various signals and barriers to protect persons and workers. Such protection is particularly important at night or darkness or at poor visibility. The use of signal devices in form of demarcation light systems of the above type is generally known.

SUMMARY OF THE INVENTION

It is an object of the present invention to provide an improved demarcation lighting system which is of simple structure and can rapidly be adapted to different operating conditions and different site profiles.

This object and others which will become apparent hereinafter is attained in accordance with the present invention by providing a lamp assembly of tubular, flexible material and attaching a coupling onto both ends of the lamp assembly for allowing detachable securement of a further lamp assembly.

By equipping each axial end of the lamp assembly with a coupling, the lighting system can be extended to a random length and thus be best suited as barrier for a respective construction site. The extension of the lighting system is very simple and rapidly effected through joining any number of lamp assemblies. The flexibility of the lamp assembly facilitates the modification of the lighting system to suit different profiles of construction sites and substantially eliminates any possibility of defeating or restricting the safety effect. Moreover, since being preferably made of flexible material, the lighting system can be rolled up by the user and temporarily stored until being utilized for a following application. Thus, the transport is simplified and the lighting system is better protected from damages.

According to another feature of the present invention, the couplings respectively attached at the ends of the lamp assembly, are provided in form of a plug on one end and in form of a socket on the other end so that two or more lamp assemblies can simply be joined together by inserting the plug of one lamp assembly into the socket of a second lamp assembly.

In order to improve the stability of the lamp assembly, a stiffening element is detachably secured in a bore of a coupling and extends longitudinally within the lamp assembly. Preferably, the stiffening element has a fluorescent surface and carries a string of lamps.

According to another feature of the present invention, the overall lighting system is provided at its lower end with a pedestal which is secured to the lower coupling and includes a base plate extending vertically to the lamp assembly, and a cable for supply of electric energy to the lighting system. Connected to the upper coupling at the pedestal-distant end of the overall lighting system is a terminal box to seal the lighting system in a watertight manner. Suitably, the terminal box is provided with a pneumatic valve in order to enable a build-up of a slight overpressure within the lighting system so that its shape and form is further stabilized in a simple manner.

Preferably, the pedestal is further provided with a distance piece which extends perpendicular to the lamp assembly and is provided with a clamping unit for attachment to the rail base of a rail. The length of the distance piece substantially equals a horizontal distance, perpendicular to the longitudinal track direction, of the clearance gauge from the closer one of the two track rails so that the lighting system precisely separates the clearance range.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 2:
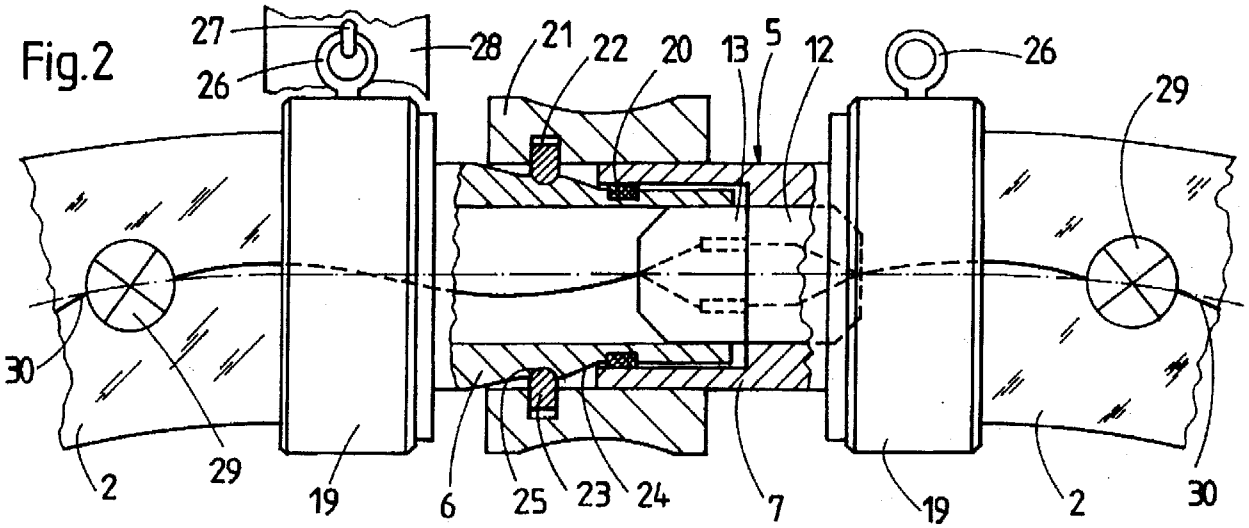
FIG. 2 is a fragmentary illustration, on an enlarged scale, of a connection between two adjoining exemplified lamp assemblies, with the coupling area being illustrated in sectional view.

Throughout all the Figures, the same or corresponding elements are always indicated by the same reference numerals.

Figure 1:
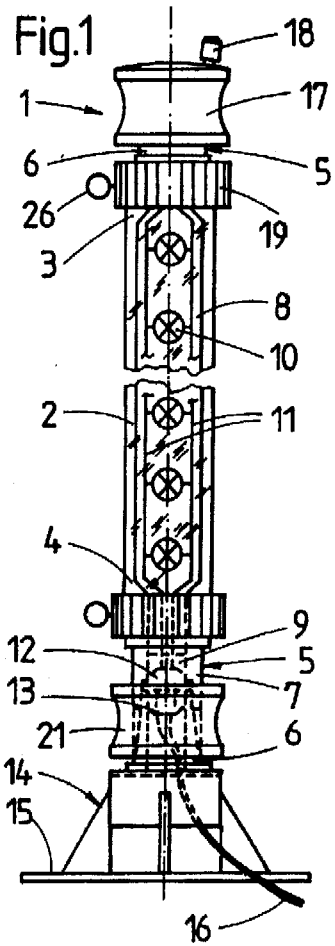
FIG. 1 is a schematic illustration of a column-like demarcation lighting system in accordance with the present invention.

Turning now to the drawing, and in particular to FIG. 1, there is shown a schematic illustration of a column-like demarcation lighting system in accordance with the present invention, generally designated by reference numeral 1. The lighting system 1 includes a lamp assembly 2 which is made of tubular, flexible and transparent material, e.g. vinyl polymer or polyethylene, and coated with the visible colors white, red, green, yellow or orange. The lamp assembly 2 may additionally contain fluorescent particles. Mounted at each end 3, 4 of the lamp assembly 2 is a coupling 5 for attachment of a further lamp assembly, whereby the coupling 5 on the upper end 3 of the lamp assembly 2 is provided in form of a plug 6 while the coupling 5 at the opposing lower end 4 is provided in form of a socket 7.

Extending longitudinally within the lamp assembly 2 is a stiffening element 8 which is received in a bore 9 of the socket-type coupling member 7 and provided to improve the stability and reinforce the lamp assembly 2. The stiffening element 8 has a width corresponding to the diameter of the lamp assembly 2 and includes a fluorescent surface. Mounted to the stiffening element 8 are a plurality of lamps 10 and pertaining electrical lines 11 for conducting electric energy from a suitable power source (not shown). The electric lines 11 terminate at one end of the stiffening element 8 in an electric plug 12 and at the opposing end of the stiffening element 8 in an electric socket 13.

Secured to the lower end 4 of the lamp assembly 2 is a pedestal 14 which includes a plug-type coupling member 6 for insertion in the complementary socket 7 of the lamp assembly 2. The pedestal 14 stands upon a horizontal base plate 15 of suitable dimensions to enable a stable placement of the lighting system 1 on a surface. The electric socket 13 located in the coupler plug 6 of the pedestal 14 is connected to a cable 16 which communicates with a not shown power source upon operation of the lighting system 1. The pedestal 14 thus forms the base component upon which nearly a random number of lamp assemblies 2 can be stacked and joined together, depending on the desired height of the column-like demarcation lighting system.

Mounted to the pedestal-distant end of such a column of adjoining lamp assemblies 2 is a terminal box 17 which is provided in form of a socket-type coupling member 7 and is simply placed upon the plug-type coupling member 6 of the last lamp assembly 2 in order to seal the overall lighting system in a watertight manner.

As described above, the stability of the lighting system 1 is ensured through incorporation of stiffening elements 8 which selectively can be removed through detachment of a coupling 5. Moreover, since the entire lighting system 1 comprised of pedestal 14 and stacked lamp assemblies 2 is sealed in a watertight and thus air-tight manner, the stability can even be further enhanced, simply by applying a slight overpressure within the lighting system 1 through arrangement of a pneumatic valve 18 which is preferably secured to the terminal box 17 and by which the overpressure within the lighting system 1 can be regulated.

Turning now to FIG. 2 there is shown a fragmentary illustration, on an enlarged scale, of a watertight plug-in connection between two adjoining exemplified lamp assemblies 2, with the coupling area being illustrated in sectional view. As shown in FIG. 2, the lamp assembly 2 on the right hand side ends in a socket-type coupling member 7 which is securely and tightly fixed to this lamp assembly by a screw cap 19 and in which the plug-type coupling member 6 of the adjoining lamp assembly 2 on the left hand side is inserted, with a screw cap 19 securely attaching the plug 6 to the pertaining lamp assembly 2.

The plug 6 has a tapered section 24 as transition between an inner section of greater diameter and an outer section of smaller diameter which is inserted in the socket 7. A sealing ring 20 is incorporated in the outer plug section adjacent the taper 24 and pressed about its outer circumference against the socket 7, when inserting the plug 6 in the socket 7, in order to seal the interior of the coupling 5 and lamp assemblies 2 against the surrounding and thus to eliminate a penetration of water or dirt and dust. The socket 7 is surrounded by a closure ring 21 which is displaceable in longitudinal direction and includes a groove 22 for receiving a spring washer 23.

The connection of the lamp assemblies 2 is carried out by inserting the plug 6 of one lamp assembly 2 into the socket 7 of the other lamp assembly 2. Thereafter, the closure ring 21 is shifted in direction towards the plug 6, with the spring washer 23 moving along the taper 24 of the plug 6. During run along the taper 24, the spring washer 23 is stretched until snapping in a groove 25 of the plug 6. In order to create a secure engagement, the groove 25 and the facing end of the spring washer 23 are of complementary configuration. The opening of the coupled connection 5 between adjoining lamp assemblies 2 is effected in reverse order.

As described above, the socket 7 and the plug 6 of each lamp assembly 2 incorporates an electric plug 12 and electric socket 13 for connection of the electric cables 30 in such a manner that upon coupling of two lamp assemblies 2 via the socket 7 and the plug 6, the electric plug 12 is automatically inserted in the socket 13 at a same time.

Attached on the outside of each screw cap 19 is a ring-shaped mounting element 26 for permitting a suspension and securement of the lighting system 1 from or to a structural element, especially when a great number of lamp assemblies 2 is linked together to form a string of lamp assemblies. The lighting system 1 can simply be attached via the mounting element 26 to a hook 27 which is secured for example to a wooden pole 28. It is also possible to suspend the lighting system 1 from a rope which is threaded through the mounting elements 26 and subsequently tensioned.

In contrast to the embodiment in FIG. 1, the lamp assembly 2 as shown in FIG. 2 is equipped with a number of small lamps 29 which are connected together by the electric cable 30 terminating again in the plug 12 and the socket 13, respectively arranged in the coupling area 5.

Figure 3:
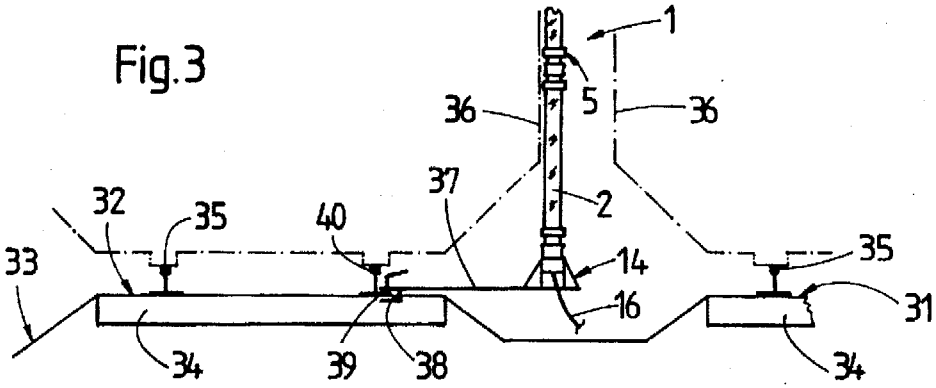
FIG. 3 is a schematic illustration of a demarcation lighting system according to the present invention for use as demarcation of the clearance gauge of a railway track.

Referring now to FIG. 3, there is shown as schematic illustration of a demarcation lighting system 1 for use at a track construction site. A track assembly 33 includes two tracks 31, 32, with each track 31, 32 being formed by rails 35, 40 fastened to successive ties 34. Indicated in FIG. 3 in greatly simplified manner by dashdot lines is a clearance gauge 36 for each track 31, 32. In the event, works are to be carried out e.g. on track 31 while trains are still running on track 32 at the same time, safety reasons require to demarcate the danger zone—in this case the clearance gauge 36 of track 32. In accordance with the present invention, this is attained by securing to the pedestal 14 of the lighting system 1 a distance piece 37 which extends perpendicular to the longitudinal axis of the lighting system 1 and includes a clamping mechanism 38 on its cantilevered free end for attachment to the rail base 39 of the nearer rail 40. Since the distance piece 37 has a length which corresponds to the horizontal distance, perpendicular to the longitudinal direction along the track, of the clearance gauge 36 from the proximate rail 40, the clearance gauge is precisely demarcated through the lighting system 1.

Persons skilled in the art will understand that the described connection in form of a plug-in coupling or quick release coupling may certainly be substituted by any other type of connection, including also a screwed connection. The structural configuration in form of a column-like lighting system in various lengths and as rollable tube material with internal lamps or stiffening elements, enables the use of such demarcation lighting systems also during daylight, as visible construction demarcation, even without illumination, to be as effective as e.g. a barrier rope. It will be further understood by persons skilled in the art that the use of the demarcation lighting system is certainly not limited to track construction sites but may also be utilized in excavations, road construction, highway construction, underground engineering and so on.

While the invention has been illustrated and described as embodied in a demarcation lighting system, it is not intended to be limited to the details shown since various modifications and structural changes may be made without departing in any way from the spirit of the present invention.

What is claimed as new and desired to be protected by Letters Patent is set forth in the appended claims:

1. A demarcation lighting system for demarcating and illuminating danger zones and work areas, comprising:

a transparent lamp assembly defining an axis and having opposing ends, said lamp assembly containing a lamp and being made of tubular, flexible material;

coupling means secured to said lamp assembly for allowing a selective detachable connection to a further lamp assembly, said coupling means including a first coupling arranged on one end of said lamp assembly and a second coupling arranged on the other end of said lamp assembly; and a pedestal detachably secured to one of said first and second couplings and including a base extending vertically to the axis of said lamp assembly and a cable for supply of electric energy.

2. The lighting system of claim 1 wherein one of said first and second couplings of said lamp assembly is provided in form of a plug, and the other one of said first and second couplings of said lamp assembly is provided in form of a socket.

3. The lighting system of claim 1 wherein said lamp assembly includes a stiffening member detachably secured and extending in longitudinal direction of the lamp assembly, with at least one of said first and second couplings being detachably secured to said lamp assembly to allow a removal of said stiffening member.

4. The lighting system of claim 3 wherein one of said couplings includes a bore, said stiffening member being plugged in said bore of said one coupling.

5. The lighting system of claim 3 wherein said stiffening member has a number of lamps and is provided with a fluorescent surface.

6. The lighting system of claim 1 wherein said coupling means is provided in form of a plug-in coupling with integrated electric plug for conduction of electric energy.

7. The lighting system of claim 1, further comprising a terminal box secured to one of said first and second couplings for sealing said lamp assembly in a watertight manner.

8. The lighting system of claim 1, further comprising a pedestal secured to one of said first and second couplings and including a base extending vertically to the axis of said lamp assembly and a cable for supply of electric energy.

9. The lighting system of claim 1 wherein said lamp assembly includes an internal electric cable supporting a plurality of lamps and connected with said first and second couplings of said lamp assembly.

10. The lighting system of claim 1 wherein each of said first and second couplings is provided with a mounting element.

11. The lighting system of claim 1, further comprising a pneumatic valve secured to said lamp assembly for generating an overpressure in said lamp assembly.

12. The lighting system of claim 7, further comprising a pneumatic valve secured to said terminal box.

13. The lighting system of claim 1 wherein said lamp assembly includes fluorescent particles.

14. The lighting system of claim 1, further comprising a distance piece extending vertically to the axis of said lamp assembly and having one end secured to said pedestal and another free end formed with a clamping unit for attachment of said distance piece.

15. The lighting system of claim 14 for use at a track site having two rails fastened to ties, said distance piece having a length which corresponds to a horizontal distance, perpendicular to a longitudinal direction of the track, of a railway clearance gauge from a proximate rail of the track.

16. A demarcation lighting system for demarcating and illuminating danger zones and work areas, comprising:

a transparent lamp assembly defining an axis and having opposing ends, said lamp assembly containing a lamp and being made of tubular, flexible material; and coupling means secured to said lamp assembly for allowing a selective detachable connection to a further lamp assembly, said coupling means including a first coupling arranged on one end of said lamp assembly and a second coupling arranged on the other end of said lamp assembly; and a pneumatic valve secured to said lamp assembly for generating an overpressure in said lamp assembly.

17. The lighting system of claim 16 wherein one of said first and second couplings of said lamp assembly is provided in form of a plug, and the other one of said first and second couplings of said lamp assembly is provided in form of a socket.

18. The lighting system of claim 16 wherein said lamp assembly includes a stiffening member detachably secured and extending in longitudinal direction of the lamp assembly, with at least one of said first and second couplings being detachably secured to said lamp assembly to allow a removal of said stiffening member.

19. The lighting system of claim 18 wherein one of said couplings includes a bore, said stiffening member being plugged in said bore of said one coupling.

20. The lighting system of claim 18 wherein said stiffening member has a number of lamps and is provided with a fluorescent surface.

21. The lighting system of claim 16 wherein said coupling means is provided in form of a plug-in coupling with integrated electric plug for conduction of electric energy.

22. The lighting system of claim 16, further comprising a terminal box secured to one of said first and second couplings for sealing said lamp assembly in a watertight manner.

23. The lighting system of claim 16 wherein said lamp assembly includes an internal electric cable supporting a plurality of lamps and connected with said first and second couplings of said lamp assembly.

24. The lighting system of claim 16 wherein each of said first and second couplings is provided with a mounting element.

25. The lighting system of claim 22, further comprising a pneumatic valve secured to said terminal box.

26. The lighting system of claim 16 wherein said lamp assembly includes fluorescent particles.

27. The lighting system of claim 16, further comprising a pedestal detachably secured to one of said first and second couplings and including a base extending vertically to the axis of said lamp assembly and a cable for supply of electric energy; and a distance piece extending vertically to the axis of said lamp assembly and having one end secured to said pedestal and another free end formed with a clamping unit for attachment of said distance piece.

28. The lighting system of claim 27 for use at a track site having two rails fastened to ties, said distance piece having a length which corresponds to a horizontal distance, perpendicular to a longitudinal direction of the track, of a railway clearance gauge from a proximate rail of the track.

29. A demarcation lighting system for demarcating and illuminating danger zones and work areas, comprising:

a transparent lamp assembly defining an axis and having opposing ends, said lamp assembly containing a lamp and being made of tubular, flexible material; and coupling means secured to said lamp assembly for allowing a selective detachable connection to a further lamp assembly, said coupling means including a first coupling arranged on one end of said lamp assembly and a second coupling arranged on the other end of said lamp assembly;

a terminal box secured to one of said first and second couplings for sealing said lamp assembly in a watertight manner; and a pneumatic valve secured to said terminal box.

30. The lighting system of claim 29 wherein one of said first and second couplings of said lamp assembly is provided in form of a plug, and the other one of said first and second couplings of said lamp assembly is provided in form of a socket.

31. The lighting system of claim 29 wherein said lamp assembly includes a stiffening member detachably secured and extending in longitudinal direction of the lamp assembly, with at least one of said first and second couplings being detachably secured to said lamp assembly to allow a removal of said stiffening member.

32. The lighting system of claim 31 wherein one of said couplings includes a bore, said stiffening member being plugged in said bore of said one coupling.

33. The lighting system of claim 31 wherein said stiffening member has a number of lamps and is provided with a fluorescent surface.

34. The lighting system of claim 29 wherein said coupling means is provided in form of a plug-in coupling with integrated electric plug for conduction of electric energy.

35. The lighting system of claim 29 wherein said lamp assembly includes an internal electric cable supporting a plurality of lamps and connected with said first and second couplings of said lamp assembly.

36. The lighting system of claim 29 wherein each of said first and second couplings is provided with a mounting element.

37. The lighting system of claim 29 wherein said lamp assembly includes fluorescent particles.

38. The lighting system of claim 29, further comprising a pedestal detachably secured to one of said first and second couplings and including a base extending vertically to the axis of said lamp assembly and a cable for supply of electric energy; and a distance piece extending vertically to the axis of said lamp assembly and having one end secured to said pedestal and another free end formed with a clamping unit for attachment of said distance piece.

39. The lighting system of claim 38 for use at a track site having two rails fastened to ties, said distance piece having a length which corresponds to a horizontal distance, perpendicular to a longitudinal direction of the track, of a railway clearance gauge from a proximate rail of the track.

* * * * *